US010140912B2

(12) United States Patent
Hekmat et al.

(10) Patent No.: US 10,140,912 B2
(45) Date of Patent: Nov. 27, 2018

(54) SHARED MULTIPOINT REVERSE LINK FOR BIDIRECTIONAL COMMUNICATION IN DISPLAYS

(71) Applicant: SAMSUNG DISPLAY CO., LTD., Yongin, Gyeonggi-Do (KR)

(72) Inventors: Mohammad Hekmat, Mountain View, CA (US); Amir Amirkhany, Sunnyvale, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 283 days.

(21) Appl. No.: 14/974,535

(22) Filed: Dec. 18, 2015

(65) Prior Publication Data

US 2017/0178562 A1 Jun. 22, 2017

(51) Int. Cl.
*G09G 3/20* (2006.01)

(52) U.S. Cl.
CPC ... *G09G 3/2096* (2013.01); *G09G 2300/0408* (2013.01); *G09G 2310/0291* (2013.01)

(58) Field of Classification Search
CPC ..... G09G 3/2096; G09G 2310/0291; G09G 2300/0408
See application file for complete search history.

(56) References Cited

U.S. PATENT DOCUMENTS 5,731,711 A * 3/1998 Gabara ..... H04L 25/0278 326/27
6,108,713 A * 8/2000 Sambamurthy ..... H04L 29/06 370/463
7,471,289 B2 12/2008 Takaki
8,638,283 B2 1/2014 Kota et al.
8,674,970 B2 3/2014 Shin
8,698,857 B2 4/2014 Kim et al.
8,847,941 B2 9/2014 Tanaka et al.
8,860,711 B2 10/2014 Kim
2002/0053923 A1 * 5/2002 Kim ..... H03K 19/0005 326/30

(Continued)

OTHER PUBLICATIONS

Ho, Andrew; Common-mode Backchannel Signaling System for Differential High-speed Links; Symposium on VLSI Circuits Digest of Technical Papers; © 2004; pp. 352-355.

*Primary Examiner* — Mihir K Rayan
(74) *Attorney, Agent, or Firm* — Lewis Roca Rothgerber Christie LLP

(57) ABSTRACT

A display interface for transmitting reverse data. The display interface includes a timing controller, a first plurality of driver integrated circuits, a first shared data lane connected to the timing controller and to each of the first plurality of driver integrated circuits, and a shared synchronization lane connected to the timing controller and to each of the first plurality of driver integrated circuits. Each of the first plurality of driver integrated circuits has a data input configured to receive reverse data from a display panel, and a buffer configured to store reverse data. The timing controller is configured to periodically send a synchronization pulse having a triggering edge. Each of the first plurality of driver integrated circuits is configured to periodically send, on the first shared data lane, reverse data to the timing controller in a respective time slot of a plurality of non-overlapping time slots, after each triggering edge.

20 Claims, 6 Drawing Sheets

(56) References Cited

U.S. PATENT DOCUMENTS

| | | | | |
|---|---|---|---|---|
| 2003/0062921 | A1* | 4/2003 | Johnson | H04L 25/0278 326/30 |
| 2005/0168426 | A1* | 8/2005 | Moon | G09G 3/3611 345/98 |
| 2006/0022603 | A1* | 2/2006 | Shiraishi | G09G 3/3648 315/169.2 |
| 2008/0094342 | A1 | 4/2008 | Kim | |
| 2009/0244047 | A1* | 10/2009 | Mizutani | G09G 3/325 345/211 |
| 2011/0102687 | A1 | 5/2011 | Ko et al. | |
| 2011/0122119 | A1* | 5/2011 | Bae | G09G 3/3233 345/211 |
| 2011/0181558 | A1* | 7/2011 | Jeon | G09G 3/3611 345/204 |
| 2013/0278571 | A1 | 10/2013 | Ahn | |
| 2014/0118235 | A1 | 5/2014 | Hong et al. | |
| 2015/0123953 | A1* | 5/2015 | Shim | G09G 3/3233 345/205 |
| 2016/0125840 | A1* | 5/2016 | Oh, II | G09G 5/006 345/213 |
| 2016/0163291 | A1* | 6/2016 | Amirkhany | G09G 5/18 345/530 |
| 2018/0122294 | A1* | 5/2018 | Do | G09G 3/3225 |

* cited by examiner

SHARED MULTIPOINT REVERSE LINK FOR BIDIRECTIONAL COMMUNICATION IN DISPLAYS

FIELD

One or more aspects of embodiments according to the present invention relate to data communication within displays, and more particularly to a system and method for transmitting reverse data from a display.

BACKGROUND

Display devices may be constructed with a timing controller (TCON) that sends high rate (e.g., video) data to driver integrated circuits (DICs) on source boards at the display panel. In addition to the video data sent in the "forward" direction from TCON to DICs, reverse data may also be sent by the DICs to the TCON. Such reverse data may carry information, for example, from sensors (e.g., touch sensors or optical sensors) embedded in the display panel. The data rate of the reverse data may be lower than (e.g., $1/10^{th}$) that of the forward data.

The use of the individual forward links as bi-directional links, e.g., in a full-duplex or half-duplex system, may result in near end crosstalk (NEXT) for the forward link and vice versa. The use of dedicated reverse lanes (one per DIC) results in a need to add traces, connectors, and cables to the system, and consequently increases cost. The addition of a chip to the source board that aggregates the data from all low-speed reverse links and sends the aggregated data back to the TCON at high speed may also increase cost, and complexity.

Thus, there is a need for a cost-effective system for transmitting reverse data from a plurality of DICs to a TCON.

SUMMARY

Aspects of embodiments of the present invention are directed toward a system and method for transmitting reverse data from a display.

According to an embodiment of the present invention there is provided a display interface, including: a timing controller; a first plurality of driver integrated circuits; a first shared data lane connected to the timing controller and to each of the first plurality of driver integrated circuits; and a shared synchronization lane connected to the timing controller and to each of the first plurality of driver integrated circuits, each of the first plurality of driver integrated circuits having: a data input configured to receive reverse data from a display panel; and a buffer configured to store reverse data, the timing controller being configured to periodically send, on the shared synchronization lane, a synchronization pulse, having a triggering edge, to all of the driver integrated circuits of the first plurality of driver integrated circuits, each of the first plurality of driver integrated circuits being configured to periodically send, on the first shared data lane, reverse data to the timing controller in a respective time slot of a plurality of non-overlapping time slots, after each triggering edge.

In one embodiment, the display includes: a second plurality of driver integrated circuits; and a second shared data lane connected to the timing controller and to each of the second plurality of driver integrated circuits; the shared synchronization lane being further connected to each of the second plurality of driver integrated circuits, each of the second plurality of driver integrated circuits having: a data input configured to receive reverse data; and a buffer configured to store reverse data, the timing controller being configured to periodically send, on the shared synchronization lane, a synchronization pulse, having a triggering edge, to all of the driver integrated circuits of the second plurality of driver integrated circuits, each of the second plurality of driver integrated circuits being configured to periodically send, on the second shared data lane, reverse data to the timing controller in a respective time slot of a plurality of non-overlapping time slots, after each triggering edge.

In one embodiment, each of the first plurality of driver integrated circuits is configured to periodically send, on the first shared data lane, reverse data to the timing controller in a respective time slot of a plurality of time slots that are. non-overlapping and separated from each other by a plurality of time intervals each having a duration equal to at least 3 times a maximum time of flight between any pair of driver integrated circuits of the first plurality of driver integrated circuits.

In one embodiment, one of: the timing controller and the first plurality of driver integrated circuits has an on-chip input-output circuit connected to the first shared data lane, wherein the input-output circuit includes a termination.

In one embodiment, the termination is a fixed impedance.

In one embodiment, the termination is programmable.

In one embodiment, the termination is configured to have a first impedance value when the input-output circuit is transmitting, and a second impedance value, different from the first impedance value, when the input-output circuit is receiving.

In one embodiment, the display includes an on-board termination connected to the first shared data lane.

According to an embodiment of the present invention there is provided a display interface, including: a timing controller; a first plurality of driver integrated circuits; and a first shared electrical lane connected to the timing controller and to each of the first plurality of driver integrated circuits; each of the first plurality of driver integrated circuits having: a data input configured to receive reverse data from a display panel; and a buffer configured to store reverse data, the timing controller being configured to periodically send, on the first shared electrical lane, a synchronization pulse, having a triggering edge, to all of the driver integrated circuits of the first plurality of driver integrated circuits, each of the first plurality of driver integrated circuits being configured to periodically send, on the first shared electrical lane, reverse data to the timing controller in a respective time slot of a plurality of non-overlapping time slots, after each triggering edge.

In one embodiment, each of the first plurality of driver integrated circuits is configured to periodically send, on the first shared data lane, reverse data to the timing controller in a respective time slot of a plurality of time slots that are non-overlapping and separated from each other by a plurality of time intervals each having a duration equal to at least 3 times a maximum time of flight between any pair of driver integrated circuits of the first plurality of driver integrated circuits.

In one embodiment, one of: the timing controller and the first plurality of driver integrated circuits has an on-chip input-output circuit connected to the first shared electrical lane, wherein the input-output circuit includes a termination.

In one embodiment, the termination is a fixed impedance.

In one embodiment, the termination is programmable.

In one embodiment, the termination is configured to have a first impedance value when the input-output circuit is transmitting, and a second impedance value, different from the first impedance value, when the input-output circuit is receiving.

In one embodiment, the display includes an on-board termination connected to the first shared electrical lane.

According to an embodiment of the present invention there is provided a display, including: a display panel; a timing controller; a first plurality of driver integrated circuits; a first shared data lane connected to the timing controller and to each of the first plurality of driver integrated circuits; and a shared synchronization lane connected to the timing controller and to each of the first plurality of driver integrated circuits, each of the first plurality of driver integrated circuits having: a data input configured to receive reverse data from the display panel; and a buffer configured to store reverse data, the timing controller being configured to periodically send, on the shared synchronization lane, a synchronization pulse, having a triggering edge, to all of the driver integrated circuits of the first plurality of driver integrated circuits, each of the first plurality of driver integrated circuits being configured to periodically send, on the first shared data lane, reverse data to the timing controller in a respective time slot of a plurality of non-overlapping time slots, after each triggering edge.

In one embodiment, each of the first plurality of driver integrated circuits is configured to periodically send, on the first shared data lane, reverse data to the timing controller in a respective time slot of a plurality of time slots that are non-overlapping and separated from each other by a plurality of time intervals each having a duration equal to at least 3 times a maximum time of flight between any pair of driver integrated circuits of the first plurality of driver integrated circuits.

In one embodiment, one of: the timing controller and the first plurality of driver integrated circuits has an on-chip input-output circuit connected to the first shared data lane, wherein the input-output circuit includes a teimination.

In one embodiment, the termination is programmable.

In one embodiment, the termination is configured to have a first impedance value when the input-output circuit is transmitting, and a second impedance value, different from the first impedance value, when the input-output circuit is receiving.

BRIEF DESCRIPTION OF THE DRAWINGS

These and other features and advantages of the present invention will be appreciated and understood with reference to the specification, claims, and appended drawings wherein:

DETAILED DESCRIPTION

The detailed description set forth below in connection with the appended drawings is intended as a description of exemplary embodiments of a shared multipoint reverse link for bidirectional communication in displays provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
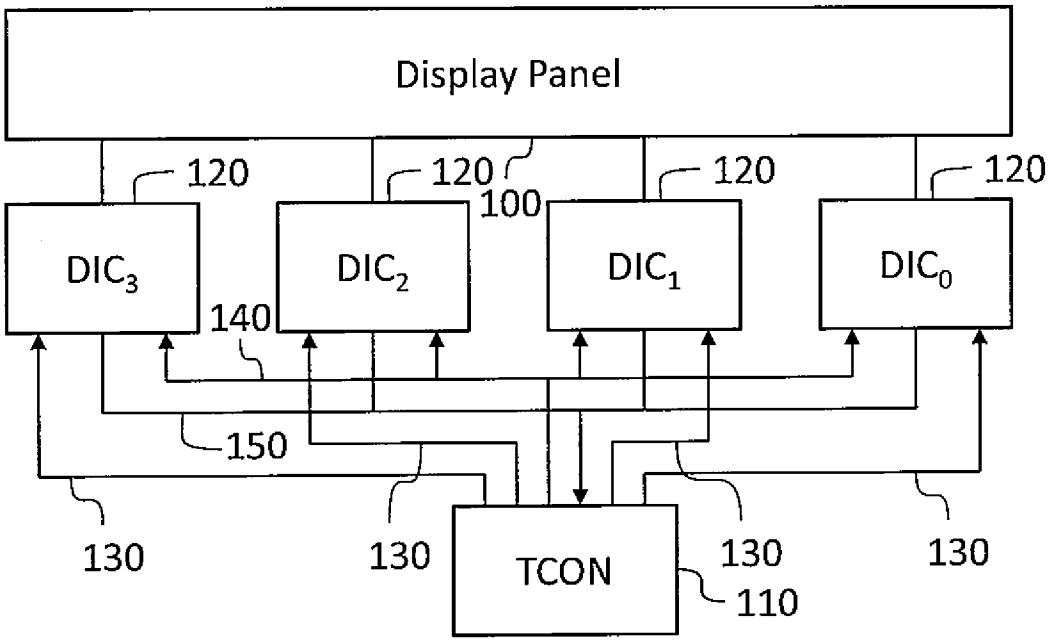
FIG. 1 is a block diagram of a shared multipoint reverse link for bidirectional communication in displays, according to an embodiment of the present invention.

Referring to FIG. 1, in one embodiment, a timing controller (TCON) 110 is connected to a plurality of source driver integrated circuits (DICs) 120 by a plurality of electrical lanes performing various functions. As used herein, a "lane" (or "electrical lane") is a conductor or a plurality of conductors configured to transmit serial data from one chip to another. A lane may include, for example, a single conductor (e.g., over a ground plane) or it may include two conductors (e.g., a driven conductor and a separate ground conductor), or it may include two driven conductors (e.g., two conductors driven with a differential signal), or three conductors including two driven conductors (e.g., two conductors driven with a differential signal) and a ground conductor.

A plurality of forward data lanes 130 may connect the TCON 110 to the DICs 120, with each forward data lane being configured to transmit display data (e.g., information that determines what is to be displayed by the display panel 100) to a respective DIC 120. A shared sync lane 140 may connect all of the DICs 120 and the TCON 110; via the shared sync lane 140, the TCON 110 may periodically (e.g., at the beginning of every new frame of video displayed by the display) provide a synchronization signal to all of the DICs 120. This synchronization signal may help to ensure that different portions of the display, driven by respective different DICs 120, remain well synchronized, to avoid picture imperfections that may otherwise result. Reverse data may be transmitted from the DICs 120 to the TCON 110 over a shared reverse data lane 150. Various approaches may be used to avoid collisions between the reverse data sent by different DICs 120.

Figure 2:
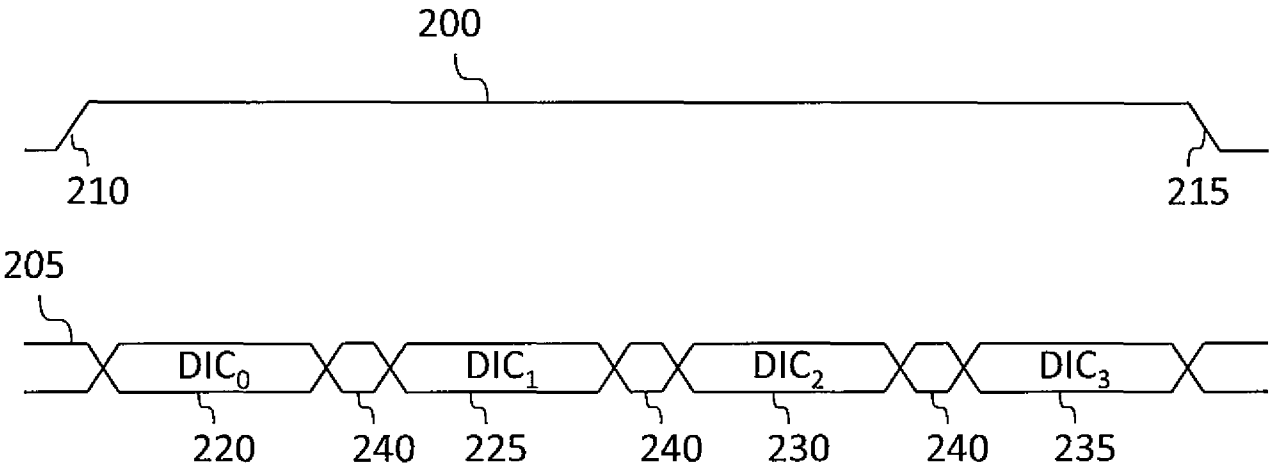
FIG. 2 is a waveform diagram of a shared multipoint reverse link for bidirectional communication in displays, according to an embodiment of the present invention.

Referring to FIG. 2, in one embodiment, the waveform 200 of the synchronization signal transmitted by the TCON 110 may include a first edge 210 and a second edge 215. One of the edges 210, 215 of the synchronization signal, referred to herein as the "triggering edge" for reverse data transmission, may be used to synchronize reverse data transmissions. The triggering edge for synchronizing the display driving functions of the DICs 120 may be the same edge as (or a different edge from) the triggering edge for synchronizing reverse data transmission. The triggering edge may be the leading edge of a pulse or the trailing edge of a pulse, and it may be a rising edge or a falling edge. In the lower portion of FIG. 2 (showing the reverse data waveform 205), time intervals during which $DIC_0$, $DIC_1$, $DIC_2$, and $DIC_3$ transmit data are labeled simply "$DIC_0$", "$DIC_1$", "$DIC_2$", and "$DIC_3$" for brevity. Referring to the reverse data waveform 205 of FIG. 2, the first DIC, e.g., $DIC_0$, may transmit data on the reverse data lane 150 during a first time slot 220, the second DIC, e.g., $DIC_1$, may transmit data on the reverse data lane 150 during a second time slot 225, the third DIC, e.g., $DIC_2$, may transmit data on the reverse data lane 150 during a third time slot 230, and the fourth DIC, e.g., $DIC_3$, may transmit data on the reverse data lane 150 during a fourth time slot 235. The time slots may be separated by spacers 240, e.g., time intervals not allocated for data transmission, that allow small imperfections in synchronization (less than the spacer width) to occur without resulting in collisions or to provide a safety window to allow proper switching of the line between different DICs. The duration of the spacers may be selected to be a multiple, e.g., 3 times, a maximum time of flight between any pair of DICs 120.

Figure 3:
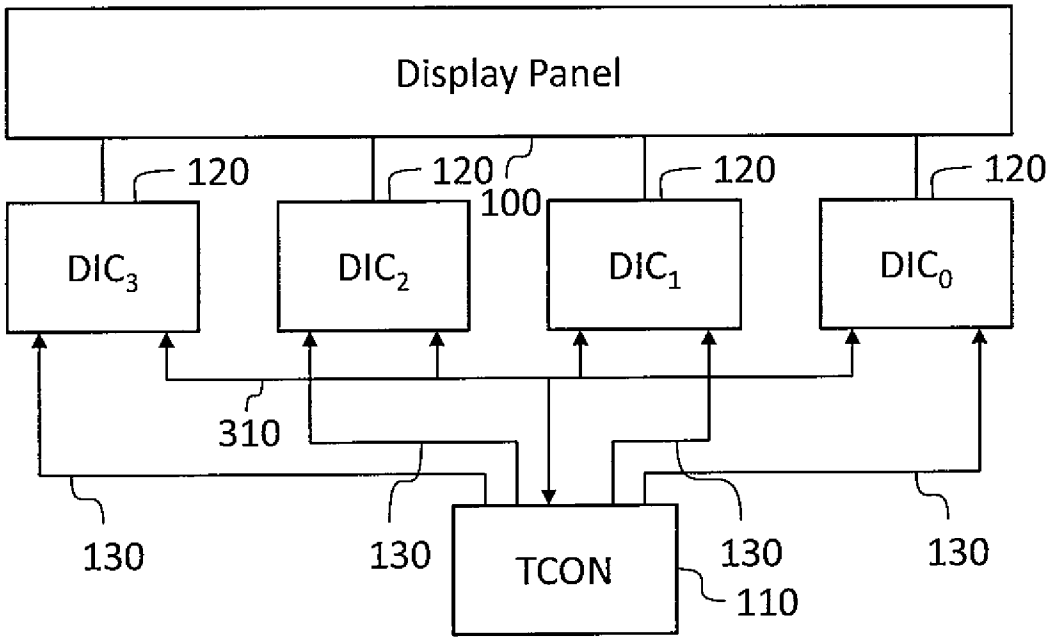
FIG. 3 is a block diagram of a shared multipoint reverse link for bidirectional communication in displays, according to an embodiment of the present invention.

Referring to FIG. 3, in one embodiment the functions of the synchronization lane and the reverse data lane are combined into a single shared dual-purpose electrical lane 310. The dual-purpose lane 310 is driven with a sync pulse by the TCON 110 during a first time interval e,g, at the beginning of each frame period, and each DIC 120 transmits reverse data during a respective time slot within the remainder of the frame period. In this embodiment, the dual-purpose lane 310 is bidirectional with respect to the TCON 110 and with respect to each of the DICs 120, in the sense that the TCON 110 transmits a signal (the sync pulse) on the dual-purpose lane 310 and also receives reverse data from each DIC 120 on the dual-purpose lane 310, and each DIC 120 receives the sync signal from the TCON 110 on the dual-purpose lane 310 and also sends reverse data to the TCON 110 on the dual-purpose lane 310.

Figure 4:
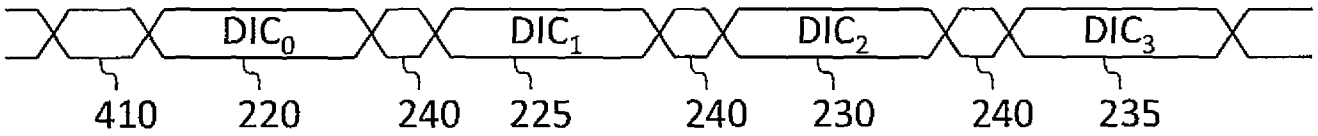
FIG. 4 is a waveform diagram of a shared multipoint reverse link for bidirectional communication in displays, according to an embodiment of the present invention.

FIG. 4 shows a waveform for the shared dual-purpose lane 310 of the embodiment of FIG. 3, including a window 410 within which the TCON 110 may transmit a sync edge. As in the embodiment of FIG. 2, the waveform of FIG. 4 illustrates that the first DIC, e.g., $DIC_0$, may transmit data during a first time slot 220, the second DIC, e.g., $DIC_1$, may transmit data during a second time slot 225, the third DIC, e.g., $DIC_2$, may transmit data during a third time slot 230, and the fourth DIC, e.g., $DIC_3$, may transmit data during a fourth time slot 235. The time slots may be separated by spacers 240, e.g., time intervals not allocated for data transmission, that allow small imperfections in synchronization (less than the spacer width) to occur without resulting in collisions. The duration of the spacers may be selected to be a multiple, e.g., 3 times, a maximum time of flight between any pair of DICs 120.

In some embodiments the DICs 120 may not rely on a pulse on the sync lane 140 to synchronize their display driving functions and to avoid picture imperfections, and in such an embodiment a sync pulse on the sync lane 140 or on the dual-purpose lane 310 may nonetheless be employed to synchronize the reverse data transmissions from the DICs 120 so as to avoid collisions.

Figure 5:
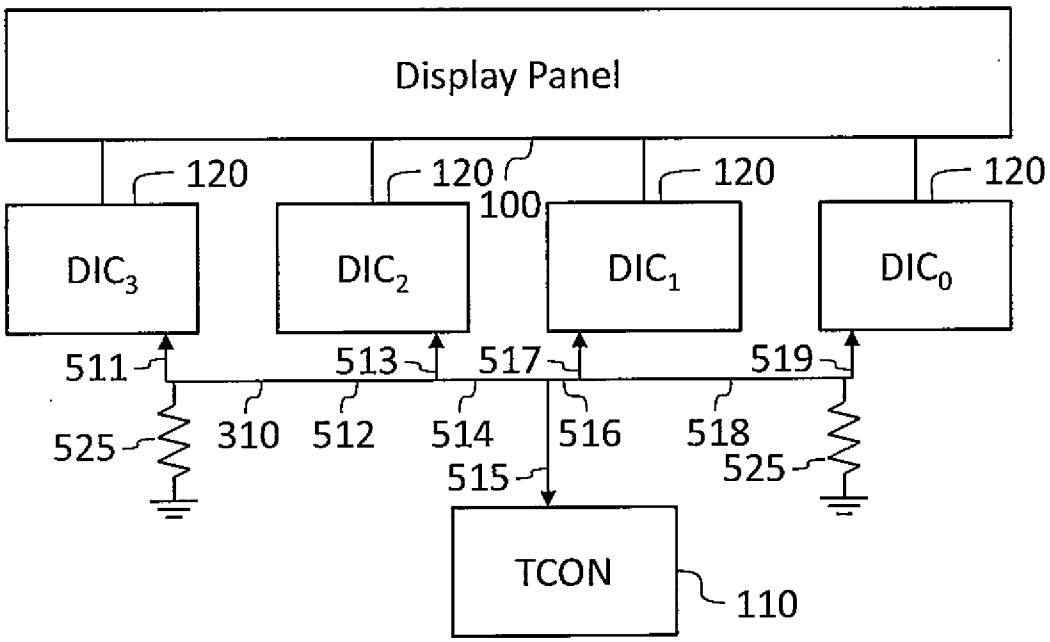
FIG. 5 is a hybrid schematic-block diagram of a shared multipoint reverse link for bidirectional communication in displays, according to an embodiment of the present invention.

Referring to FIG. 5, various provisions may be employed in the system to provide acceptable signal integrity, i.e., so that signal reflections in the reverse data lane 150 or to the dual-purpose lane 310 do not introduce unacceptable errors. For example, the TCON 110 may include an input-output circuit connected, through an input-output pin, to the dual-purpose lane 310 (or to the reverse data lane 150, shown in FIG. 1); this input-output circuit may include an on-chip termination, such as a fixed (e.g., resistive) impedance. In other embodiments the input-output circuit includes a transistor biased to a fixed bias condition to act as a resistor, or it includes a programmable termination (e.g., an array of resistive terminations, connected to the input-output pin through switching transistors). In one embodiment the TCON 110 input-output circuit has a dynamically switched on-chip termination that has a first impedance when the TCON 110 is driving the dual-purpose lane 310, and a second impedance when the TCON 110 is not driving the dual-purpose lane 310, and is instead receiving reverse data.

Similarly each DIC 120 may have an input-output circuit connected to the reverse data lane 150 or to the dual-purpose lane 310, the input-output circuit including an on-chip termination, a programmable termination, or a dynamically switched on-chip termination. In one embodiment each input-output circuit (whether in the TCON 110 or in one of the DICs 120) is a dynamically switched on-chip termination, and provides a relatively low impedance when the input-output circuit is transmitting, and a relatively high impedance when the input-output circuit is receiving.

The reverse data lane 150 or the dual-purpose lane 310 may be a transmission line with a piecewise-constant characteristic impedance (where the characteristic impedance refers to the differential mode characteristic impedance if the lane is driven with a differential signal). For example, the characteristic impedance may be constant (e.g., 50 ohms) over the entire length of the transmission line, or the lane may be composed of segments 511-519, each of which may have the same characteristic impedance, or some or all of which may have respective characteristic impedances differing from the respective characteristic impedances of the other segments. Moreover, one or more lumped external "on-board" terminations 525 may be provided at one or more points along the reverse data lane 150 or the dual-purpose lane 310. The terminations 525 are shown as resistors to ground in FIG. 5; in some embodiments they include reactive components and/or are connected between the driven conductors of the lane, if the lane is driven with a differential signal.

In one embodiment, the values of on-chip terminations, external terminations, and transmission line impedances are determined in a process involving circuit simulation, in which various configurations, each corresponding to a combination of impedance values, are simulated, one combination at a time, and a measure of performance (e.g., a measure of simulated signal integrity or a measure of simulated error rate) is assigned to each configuration. The configuration with the best measure of performance may then be selected and a corresponding system may be manufactured. The forward data lanes 130 are not shown in FIG. 5 for clarity.

In some embodiments, at power-up of a display, the TCON 110 may send initialization commands to each of the DICs 120. Such commands may include assigning to each DIC 120 a number (e.g., 0, 1, 2, or 3, in the embodiment of FIG. 3) so that each DIC 120 may then transmit during the corresponding time slot during each frame. Each DIC 120 may for example include a register for storing this number. Each DIC 120 may set the timing of reverse data transmissions by waiting for each sync pulse and then waiting a specified time after receiving each sync pulse before transmitting reverse data. In another embodiment, the DIC 120 may include a local clock that is phase-locked to the TCON clock using a clock signal (e.g., a forwarded clock signal or an embedded clock signal) associated with the forward data link between the TCON 110 and the DIC. Moreover, once the DIC 120 has acquired phase lock and received one initial sync pulse from the ICON 110, it may become synchronized to the TCON 110, e.g., it may operate a system time counter synchronized to a system time counter on the TCON 110. In this embodiment the DIC 120 may set the timing of reverse data transmissions using the DIC's system time counter and information about system times at which video frame refreshes begin (i.e., at which sync pulses occur).

Figure 6:
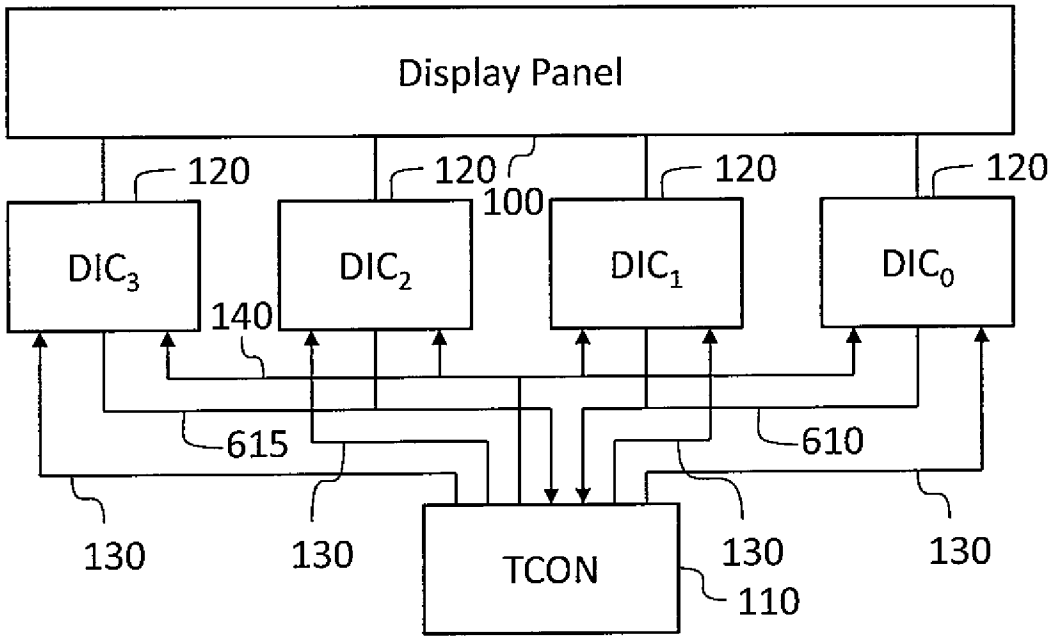
FIG. 6 is a block diagram of a shared multipoint reverse link for bidirectional communication in displays, according to an embodiment of the present invention.

Referring to FIG. 6, in some embodiments a plurality of groups of DICs 120 (e.g., two groups, a first group including $DIC_0$ and $DIC_1$, and a second group including $DIC_2$ and $DIC_3$) is connected to the TCON as shown. All of the DICs may share the shared sync lane 140; a first group of DICs ($DIC_0$ and $DIC_1$) may share a first shared reverse data lane 610, and a second group of DICs ($DIC_2$ and $DIC_3$) may share a second shared reverse data lane 615. In FIG. 6, only two DICs are shown in each group; in some embodiments each group includes more than 2 DICs.

It will be understood that, although the teinis "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration.

As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

The shared multipoint reverse link for bidirectional communication in displays and/or any other relevant devices or components according to embodiments of the present invention described herein may be implemented utilizing any suitable hardware, firmware (e.g. an application-specific integrated circuit), software, or a combination of software, firmware, and hardware. For example, the various components of the shared multipoint reverse link for bidirectional communication in displays may be formed on one integrated circuit (IC) chip or on separate IC chips. Further, the various, components of the shared multipoint reverse link for bidirectional communication in displays may be implemented on a flexible printed circuit film, a tape carrier package (TCP), a printed circuit board (PCB), or formed on one substrate. Further, the various components of the shared multipoint reverse link for bidirectional communication in displays may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Although exemplary embodiments of a shared multipoint reverse link for bidirectional communication in displays have been specifically described and illustrated herein, many modifications and variations will be apparent to those skilled in the art. Accordingly, it is to be understood that a shared multipoint reverse link for bidirectional communication in displays constructed according to principles of this invention may be embodied other than as specifically described herein. The invention is also defined in the following claims, and equivalents thereof.

What is claimed is:

1. A display interface, comprising:

a timing controller;

a first plurality of driver integrated circuits;

a first shared data lane connected to the timing controller and to each of the first plurality of driver integrated circuits; and a shared synchronization lane connected to the timing controller and to each of the first plurality of driver integrated circuits, each of the first plurality of driver integrated circuits having:

a data input configured to receive reverse data from a display panel; and a buffer configured to store reverse data, the timing controller being configured to periodically send, on the shared synchronization lane, a synchronization pulse, having a triggering edge, to all of the driver integrated circuits of the first plurality of driver integrated circuits, each of the first plurality of driver integrated circuits being configured to periodically send, on the first shared data lane, reverse data to the timing controller in a respective time slot of a plurality of non-overlapping time slots, after each triggering edge.

2. The display interface of claim 1, further comprising:

a second plurality of driver integrated circuits; and a second shared data lane connected to the timing controller and to each of the second plurality of driver integrated circuits;

the shared synchronization lane being further connected to each of the second plurality of driver integrated circuits, each of the second plurality of driver integrated circuits having:

a data input configured to receive reverse data; and a buffer configured to store reverse data, the timing controller being configured to periodically send, on the shared synchronization lane, a synchronization pulse, having a triggering edge, to all of the driver integrated circuits of the second plurality of driver integrated circuits, each of the second plurality of driver integrated circuits being configured to periodically send, on the second shared data lane, reverse data to the timing controller in a respective time slot of a plurality of non-overlapping time slots, after each triggering edge.

3. The display interface of claim 1, wherein each of the first plurality of driver integrated circuits is configured to periodically send, on the first shared data lane, reverse data to the timing controller in a respective time slot of a plurality of time slots that are non-overlapping and separated from each other by a plurality of time intervals each having a duration equal to at least 3 times a maximum time of flight between any pair of driver integrated circuits of the first plurality of driver integrated circuits.

4. The display interface of claim 1, wherein one of:

the timing controller and the first plurality of driver integrated circuits has an on-chip input-output circuit connected to the first shared data lane, wherein the input-output circuit comprises a termination.

5. The display interface of claim 4, wherein the termination is a fixed impedance.

6. The display interface of claim 4, wherein the termination is programmable.

7. The display interface of claim 4, wherein the termination is configured to have a first impedance value when the input-output circuit is transmitting, and a second impedance value, different from the first impedance value, when the input-output circuit is receiving.

8. The display interface of claim 1, comprising an on-board termination connected to the first shared data lane.

9. A display interface, comprising:

a timing controller;

a first plurality of driver integrated circuits; and a first shared electrical lane connected to the timing controller and to each of the first plurality of driver integrated circuits;

each of the first plurality of driver integrated circuits having:

a data input configured to receive reverse data from a display panel; and a buffer configured to store reverse data, the timing controller being configured to periodically send, on the first shared electrical lane, a synchronization pulse, having a triggering edge, to all of the driver integrated circuits of the first plurality of driver integrated circuits, each of the first plurality of driver integrated circuits being configured to periodically send, on the first shared electrical lane, reverse data to the timing controller in a respective time slot of a plurality of non-overlapping time slots, after each triggering edge.

10. The display interface of claim 9, wherein each of the first plurality of driver integrated circuits is configured to periodically send, on the first shared electrical lane, reverse data to the timing controller in a respective time slot of a plurality of time slots that are non-overlapping and separated from each other by a plurality of time intervals each having a duration equal to at least 3 times a maximum time of flight between any pair of driver integrated circuits of the first plurality of driver integrated circuits.

11. The display interface of claim 9, wherein one of:

the timing controller and the first plurality of driver integrated circuits has an on-chip input-output circuit connected to the first shared electrical lane, wherein the input-output circuit includes a termination.

12. The display interface of claim 11 wherein the termination is a fixed impedance.

13. The display interface of claim 11 wherein the termination is programmable.

14. The display interface of claim 11 wherein the termination is configured to have a first impedance value when the input-output circuit is transmitting, and a second impedance value, different from the first impedance value, when the input-output circuit is receiving.

15. The display interface of claim 9, comprising an on-board termination connected to the first shared electrical lane.

16. A display, comprising:

a display panel;

a timing controller;

a first plurality of driver integrated circuits;

a first shared data lane connected to the timing controller and to each of the first plurality of driver integrated circuits; and a shared synchronization lane connected to the timing controller and to each of the first plurality of driver integrated circuits, each of the first plurality of driver integrated circuits having:

a data input configured to receive reverse data from the display panel; and a buffer configured to store reverse data, the timing controller being configured to periodically send, on the shared synchronization lane, a synchronization pulse, having a triggering edge, to all of the driver integrated circuits of the first plurality of driver integrated circuits, each of the first plurality of driver integrated circuits being configured to periodically send, on the first shared data lane, reverse data to the timing controller in a respective time slot of a plurality of non-overlapping time slots, after each triggering edge.

17. The display of claim 16, wherein each of the first plurality of driver integrated circuits is configured to periodically send, on the first shared data lane, reverse data to the timing controller in a respective time slot of a plurality of time slots that are non-overlapping and separated from each other by a plurality of time intervals each having a duration equal to at least 3 times a maximum time of flight between any pair of driver integrated circuits of the first plurality of driver integrated circuits.

18. The display of claim 16, wherein one of:

the timing controller and the first plurality of driver integrated circuits has an on-chip input-output circuit connected to the first shared data lane, wherein the input-output circuit includes a termination.

19. The display of claim 18, wherein the termination is programmable.

20. The display of claim 18, wherein the termination is configured to have a first impedance value when the input-output circuit is transmitting, and a second impedance value, different from the first impedance value, when the input-output circuit is receiving.

* * * * *